US008720204B2

(12) United States Patent
Schilp et al.

(10) Patent No.: US 8,720,204 B2
(45) Date of Patent: May 13, 2014

(54) RESONATOR SYSTEM WITH ENHANCED COMBUSTOR LINER COOLING

(75) Inventors: Reinhard Schilp, Orlando, FL (US); Muzaffer Sutcu, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 723 days.

(21) Appl. No.: 13/023,710

(22) Filed: Feb. 9, 2011

(65) Prior Publication Data

US 2012/0198854 A1 Aug. 9, 2012

(51) Int. Cl.
*F02C 7/24* (2006.01)

(52) U.S. Cl.
USPC ..... 60/725; 415/119; 431/114; 181/213; 181/273

(58) Field of Classification Search
USPC ..... 60/725, 752–760; 415/119; 431/114; 181/213, 210, 211, 212, 273, 276, 292, 181/293
See application file for complete search history.

(56) References Cited

U.S. PATENT DOCUMENTS 3,850,261 A 11/1974 Hehmann et al.
4,199,936 A 4/1980 Cowan et al.
5,590,849 A 1/1997 Pla
5,685,157 A 11/1997 Pandalai et al.
6,018,950 A 2/2000 Moeller
6,530,221 B1 3/2003 Sattinger et al.
6,550,574 B2 4/2003 Liu
6,837,051 B2 1/2005 Mandai et al.
6,973,790 B2 12/2005 Suenaga et al.
7,080,514 B2 7/2006 Bland et al.
7,089,741 B2 8/2006 Ikeda et al.
7,104,065 B2 9/2006 Benz et al.
7,334,408 B2 * 2/2008 Bethke et al. ..... 60/725
7,413,053 B2 8/2008 Wasif et al.
7,549,506 B2 6/2009 Sattinger
2005/0144950 A1 7/2005 Flohr et al.
2008/0041058 A1 2/2008 Johnson et al.
2008/0087019 A1 4/2008 Macquisten et al.

* cited by examiner

*Primary Examiner* — Andrew Nguyen

(57) ABSTRACT

A combustor liner has a plurality of resonators formed thereon. Each resonator has a radially outer wall and at least one side wall. The outer wall can be free of holes. Each resonator has an inner cavity defined between the outer wall, the at least one side wall and the outer peripheral surface of the liner. The at least one side wall of each resonator surrounds a subset of a plurality of holes that extend substantially radially through the liner. A plurality of cooling passages extends generally longitudinally within the liner. Each cooling passage has an inlet in fluid communication with the exterior of the liner and an outlet in fluid communication with the inner cavity of a respective one of the resonators. A coolant, such as compressor air, can enter and flow along the cooling passages to thereby cool the liner and purge the inner cavity of the resonator.

20 Claims, 7 Drawing Sheets

RESONATOR SYSTEM WITH ENHANCED COMBUSTOR LINER COOLING

FIELD OF THE INVENTION

The invention generally relates to turbine engines, and more particularly to the cooling of a combustor liner in a turbine engine.

BACKGROUND OF THE INVENTION

A turbine engine has a compressor section, a combustor section and a turbine section. In operation, the compressor section can induct ambient air and compress it. The compressed air can enter the combustor section and can be distributed to each of the combustors therein. FIG. 1 shows one example of a known combustor 10. The combustor 10 can include a pilot swirler 12 (or more generally, a pilot burner). A plurality of main swirlers 14 can be arranged circumferentially about the pilot swirler 12. Fuel is supplied to the pilot swirler 12 and separately to the plurality of main swirlers 14 by fuel supply nozzles (not shown). When the compressed air 16 enters the combustor 10, it is mixed with fuel in the pilot swirler 12 as well as in the surrounding main swirlers 14. Combustion of the air-fuel mixture occurs downstream of the swirlers 12, 14 in a combustion zone 20, which can be largely enclosed within a combustor liner 22. As a result, a hot working gas 23 is formed. The hot working gas 23 can be routed to the turbine section, where the gas can expand and generate power that can drive a rotor.

During engine operation, acoustic pressure oscillations at undesirable frequencies can develop in the combustor section due to, for example, burning rate fluctuations inside the combustor section. Such pressure oscillations can damage components in the combustor section. To avoid such damage, one or more acoustic damping devices can be associated with the combustor section of a turbine engine. One commonly used acoustic damping device is a resonator 24, which can be a Helmholtz resonator. Various examples of Helmholtz resonators are disclosed in U.S. Pat. Nos. 6,530,221 and 7,080,514. Generally, a resonator 24 can be formed by attaching a resonator box 26 to a surface of a combustor section component, such as an outer peripheral surface 28 of the combustor liner 22. A plurality of resonators 24 can be aligned circumferentially about the liner 22.

Each resonator 24 can be tuned to provide damping at a desired frequency or across a range of frequencies. A radially outer wall 30 of the resonator box 26 can include a plurality of holes 32 therein. Further, the liner 22 can be perforated with holes 38. Each resonator box 26 is welded to the liner 22 around a group 39 of the holes 38. Air enters an internal cavity of the resonator 24 through the holes 32 in the radially outer wall 30 of the resonator box 26. The internal cavity is formed between the resonator box 26 and the liner 22. The air can exit the resonator 24 by flowing through the holes 38 in the liner 22. In this way, air can purge an internal cavity and can prevent the ingestion of hot gases 23 from within the liner 54 into the resonator 50.

In addition to acoustic damping, the resonators 24 can serve an important cooling function. For instance, air passing through the holes 32 can directly impinge on the hot surface of the liner 22, thereby providing impingement cooling to the liner 22. In addition, the air exiting the resonator 24 through holes 38 in the liner 22 can provide a film cooling effect on the inner peripheral surface 40 of the liner 22.

However, the effectiveness of such cooling flows is limited primarily to the portion of the liner 22 enclosed by the resonator box 26. The portions of the liner 22 downstream thereof are not effectively cooled, despite such area being subjected to some of the highest heat loads. Further, the greater the amount of air that is used for cooling the liner, the greater the loss in engine efficiency and an emissions penalty is incurred, as there will be greater amounts of NOx in the turbine exhaust.

Thus, there is a need for a system that can minimize such concerns.

SUMMARY OF THE INVENTION

In one respect, embodiments of the invention are directed to a resonator system for a turbine engine. The system includes a hollow combustor component, which can be, for example, a combustor liner. The combustor component has an outer peripheral surface and an inner peripheral surface. A first plurality of holes extends substantially radially through the combustor component from the inner peripheral surface to the outer peripheral surface. The first plurality of holes is distributed circumferentially about the combustor component.

A first plurality of resonators is formed with the combustor component. Each resonator has a radially outer wall and one or more side walls. In one embodiment, the radially outer wall of one or more of the resonators is free of holes. Each resonator has an inner cavity, which is defined between the radially outer wall, the one or more side walls and the combustor component. The one or more side walls of each resonator surround a subset of the first plurality of holes. The first plurality of resonators is substantially circumferentially aligned about the combustor component to form a first row of resonators. In one embodiment, for at least one of the first plurality of resonators, the radially outer wall and the one or more side walls can be formed as a resonator box. The one or more side walls of the resonator box can be attached to the combustor component so that the resonator box protrudes outwardly from the outer peripheral surface of the combustor component.

A first plurality of cooling passages extends generally longitudinally within the combustor component. The first plurality of cooling passages can be substantially straight, or at least a portion of one or more of the plurality of first cooling passages can be non-straight. Each of the first plurality of cooling passages has an inlet in fluid communication with the exterior of the combustor component and an outlet in fluid communication with the inner cavity of a respective one of the resonators. In one embodiment, the inlets of the first plurality of cooling passages can be located upstream of the resonator relative to the direction of a fluid flow within the combustor component. Alternatively, the inlets of the first plurality of cooling passages can be located downstream of the resonator relative to the direction of a fluid flow within the combustor component.

In one embodiment, the combustor component can be formed by an inner panel and an outer panel. The plurality of first cooling passages can be defined by the inner and outer panels. The plurality of first cooling passages may be defined by a plurality of channels formed in the inner panel and/or the outer panel. Alternatively, there can be an intermediate panel disposed between the inner and outer panels. In such case, one or more of the plurality of first cooling passages can be defined in part by a plurality of channels formed in the intermediate panel.

The inner cavity can be defined in part by a recess formed in the inner panel. In such case, the recess can be at least partly defined by a wall. In one embodiment, the cooling passages can have an outlet formed in the wall. Alternatively, the cooling passages extend toward but stop short of the recess. In such case, an outlet of each of the cooling passages is separated from the recess. The outlets of the cooling passages and the recess can be enclosed within the one or more side walls of a respective one of the resonators. In one embodiment, the inner cavity can be defined in part by a plurality of recesses formed in the inner panel. In such case, the one or more side walls of each resonator can surround a subset of the plurality of recesses.

In one embodiment, the system can include a second plurality of holes that extend substantially radially through the combustor component. The first plurality of holes can be distributed circumferentially about the combustor component. A second plurality of resonators can be formed with the combustor component. Each resonator of the second plurality of resonators can have a radially outer wall and one or more side walls. Each resonator can have an inner cavity defined between the radially outer wall, the one or more side walls and the outer peripheral surface of the combustor component. The one or more side walls of each resonator can surround a subset of the second plurality of holes. The second plurality of resonators can be substantially circumferentially aligned about the combustor component to form a second row of resonators.

A second plurality of cooling passages can extend generally longitudinally within the combustor component. Each of the second plurality of cooling passages can have an inlet in fluid communication with the exterior of the combustor component. Further, each of the second plurality of cooling passages can have an outlet in fluid communication with the inner cavity of a respective one of the second plurality of resonators. In one embodiment, the inlets of the first plurality of cooling passages can be located upstream of the first plurality of resonators relative to the direction of a fluid flow within the combustor component, and the inlets of the second plurality of cooling passages can be located downstream of the first plurality of resonator relative to the direction of a fluid flow within the combustor component. One or more of the first plurality of cooling passages can pass between two neighboring resonators of the second plurality of resonators.

In another respect, embodiments of the invention are directed to a resonator system for a turbine engine. The system includes a hollow combustor liner. The liner has an outer peripheral surface and an inner peripheral surface. A plurality of holes extends substantially radially through the combustor liner. The plurality of holes is distributed circumferentially about the combustor liner. The combustor liner is formed by a plurality of panels.

A plurality of resonators is formed with the combustor liner. Each resonator has a radially outer wall and one or more side walls. In one embodiment, the radially outer wall of at least one of the plurality of resonators can be free of holes. Each resonator has an inner cavity that is defined between the radially outer wall, the one or more side walls and the combustor liner. The one or more side walls of each resonator surround a subset of the first plurality of holes. The plurality of resonators is substantially circumferentially aligned about the combustor liner to form a first row of resonators.

A plurality of cooling passages extends generally longitudinally within the combustor liner. Each cooling passage has an inlet in fluid communication with the exterior of the combustor component. Each cooling passage has an outlet in fluid communication with the inner cavity of a respective one of the resonators. The plurality of cooling passages is defined in part by channels formed in at least one of the plurality of panels.

The inlets of one or more of the plurality of cooling passages can be located upstream of the resonator relative to the direction of a fluid flow within the combustor liner. The inlets of one or more of the plurality of cooling passages can be located downstream of the resonator relative to the direction of a fluid flow within the combustor liner.

DETAILED DESCRIPTION OF EMBODIMENTS OF THE INVENTION

Embodiments of the invention are directed to a resonator system for cooling a combustor liner using resonators. Aspects of the invention will be explained in connection with various configurations, but the detailed description is intended only as exemplary. Embodiments of the invention are shown in FIGS. 2-11, but the present invention is not limited to the illustrated structure or application.

Figure 1:
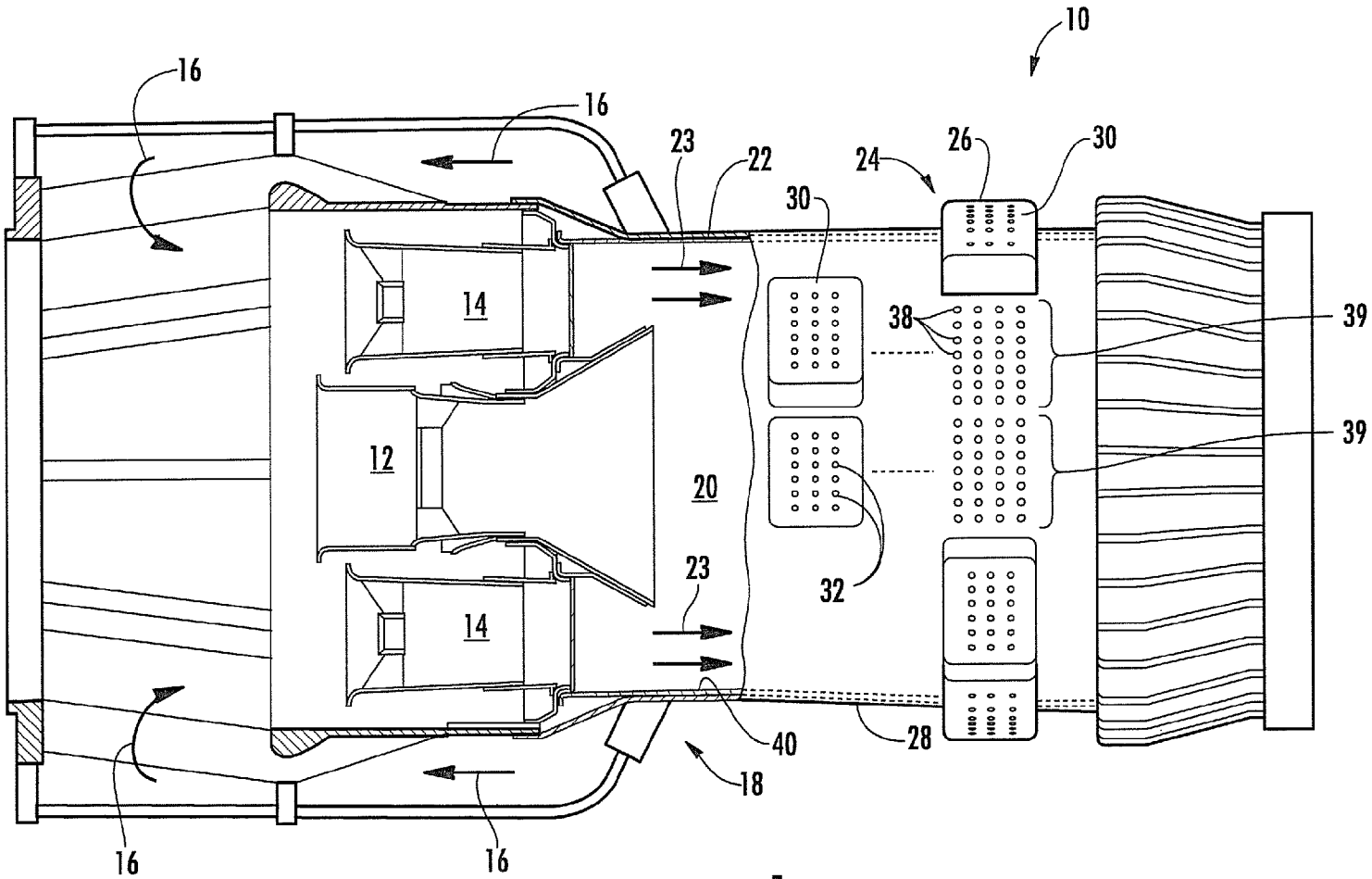
FIG. 1 (PRIOR ART)
FIG. 1 is a side elevation view of a prior art combustor, partly in cross-section to show the interior of the combustor and partly exploded to show holes in the combustor liner.
Figure 2:
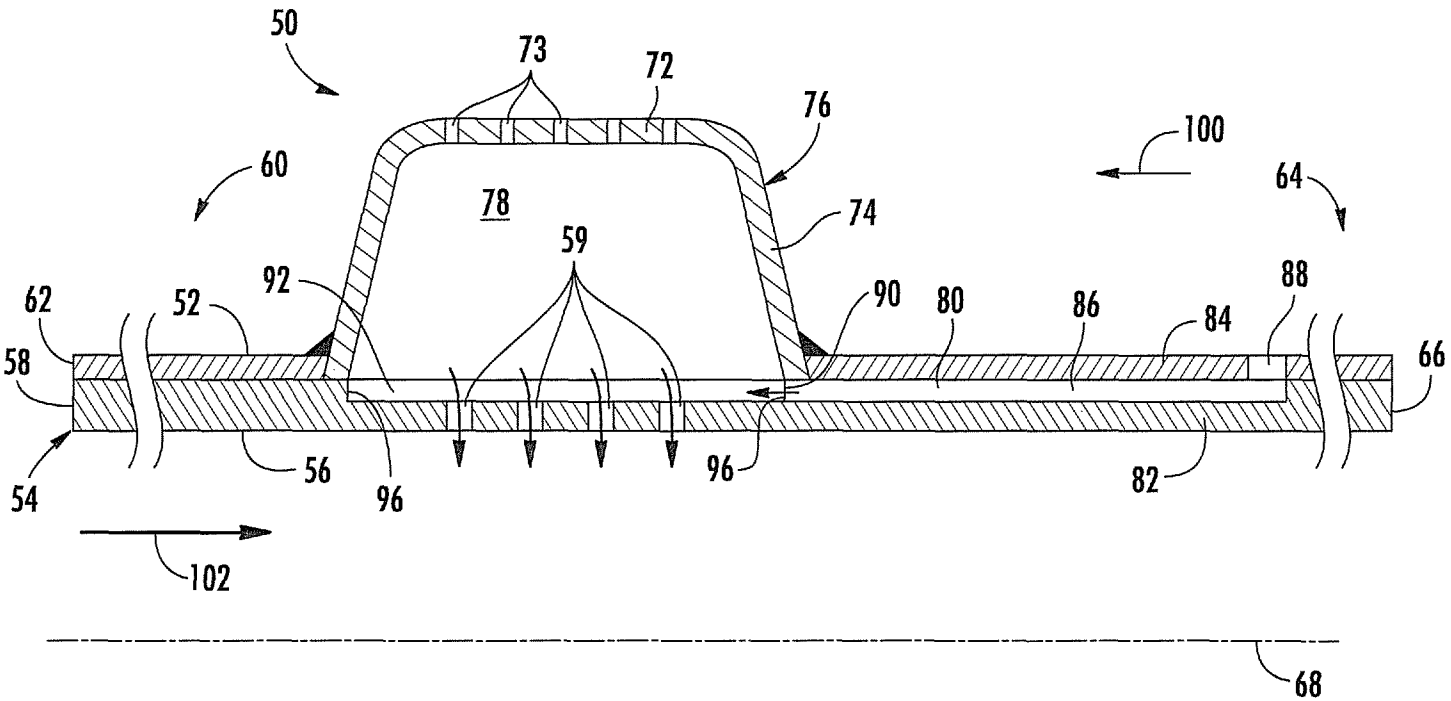
FIG. 2 is a side elevation cross-sectional view of a resonator system for cooling a portion of a combustor liner according to aspects of the invention.

As is shown in FIG. 2, one or more damping devices can be formed with a surface of a combustor component. For example, a plurality of resonators 50 (only one of which is shown) can be formed with an outer peripheral surface 52 of a combustor component, such as a liner 54 or a transition duct, to thereby form a plurality of resonators 50. The liner 54 can also have an inner peripheral surface 56.

Figure 4:
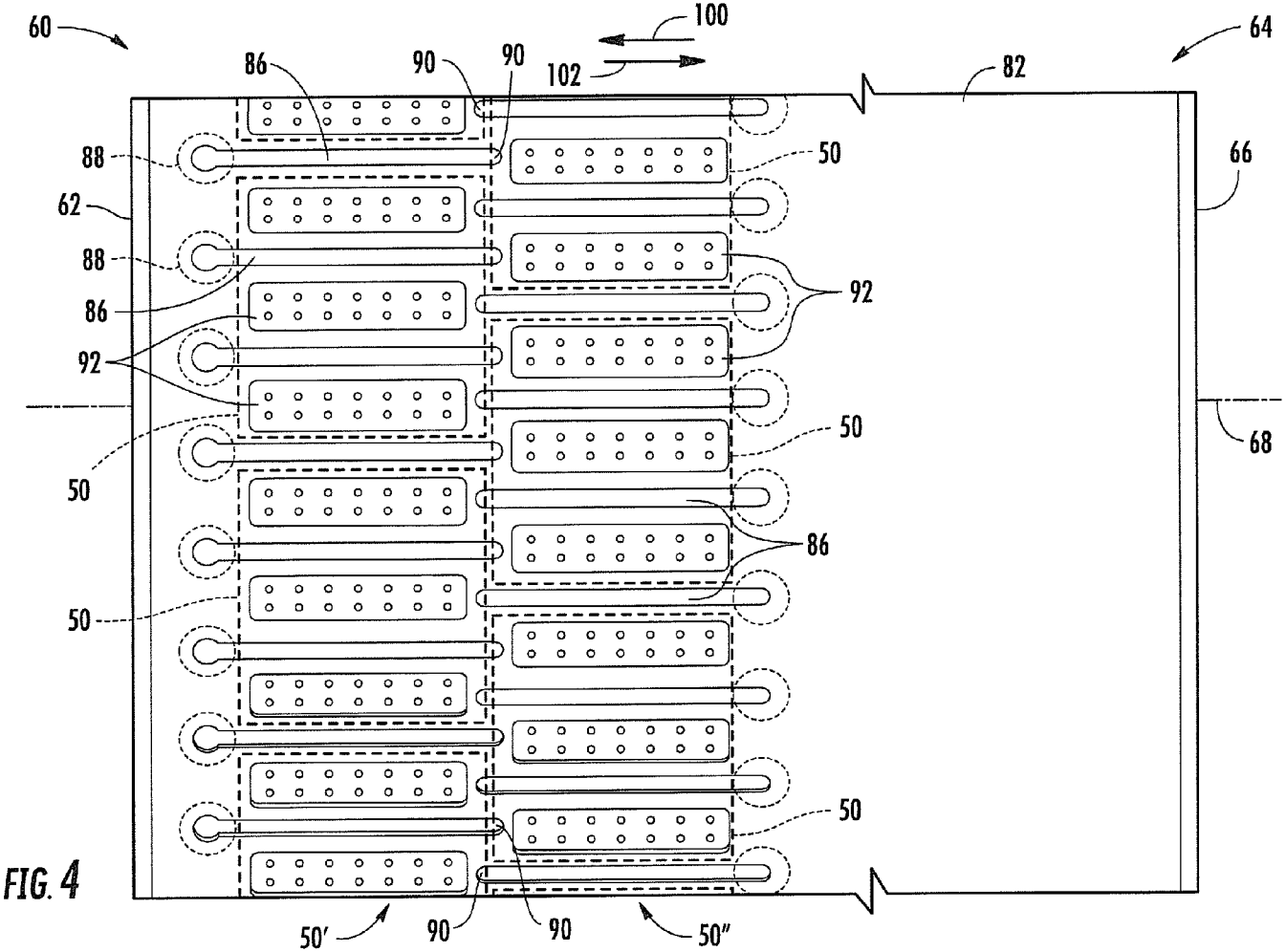
FIG. 4 is a side elevation view of a portion of an inner panel of a combustor liner according to aspects of the invention, wherein certain features of an outer panel and resonator boxes are shown for reference.
Figure 5:
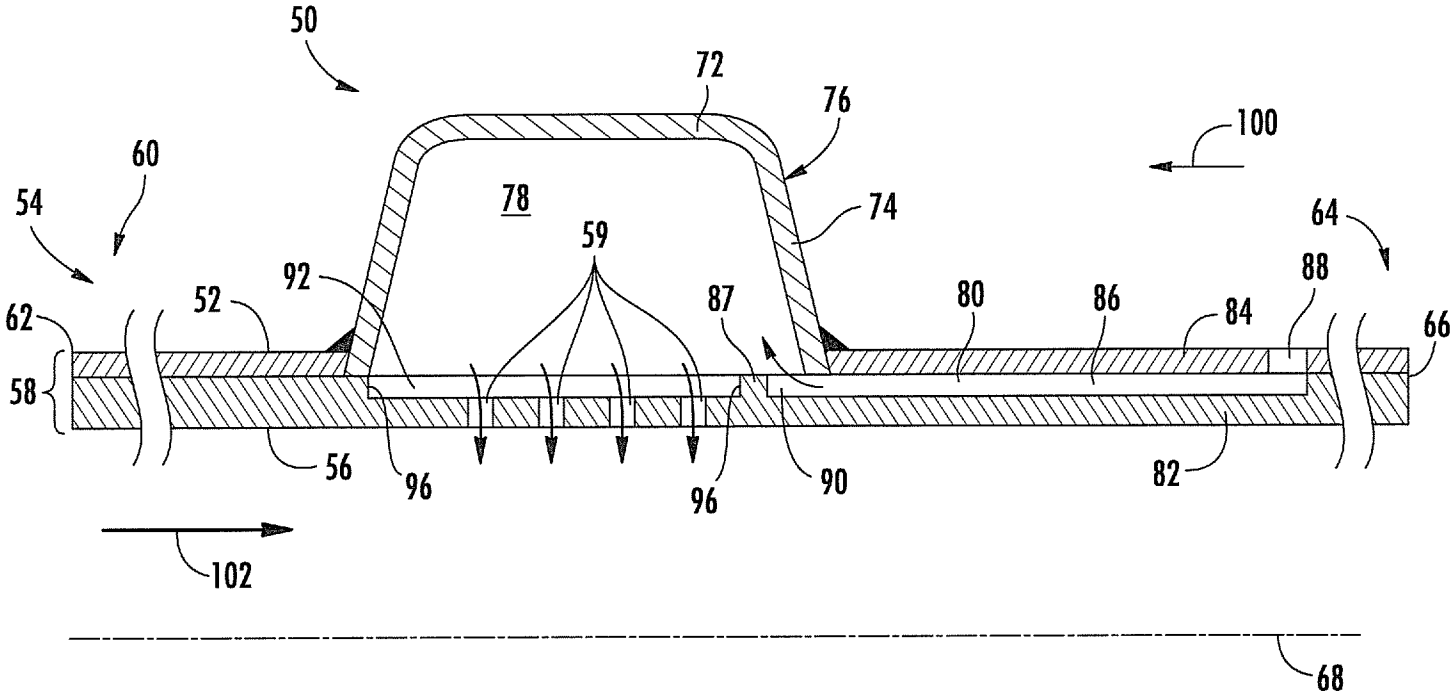
FIG. 5 is a side elevation cross-sectional view of a resonator system for cooling a portion of a combustor liner according to aspects of the invention, showing an alternative configuration for an outlet of a cooling passage.

The liner 54 has a body 58 and can include an upstream end region 60 including an upstream end 62 (see FIGS. 2, 4 and 5) and a downstream end region 64 including a downstream end 66 (see FIGS. 2, 4 and 5). The terms "upstream" and "downstream" are intended to mean relative to the direction of fluid flow 102 within the liner 54 during engine operation. The liner 54 can have an associated longitudinal axis 68. The terms "inner" and "outer" are intended to mean relative to the longitudinal axis 68 of the liner 54.

The body 58 of the liner 54 can be substantially tubular. The liner 54 can have any suitable cross-sectional conformation, including, for example, being substantially circular, oval, rectangular or polygonal. The cross-sectional size and/or shape of the liner 54 can be substantially constant along its length or it can vary along at least a portion of its length.

A plurality of holes 59 can be formed in the liner 54. The holes 59 can extend through the liner 54 from the outer peripheral surface 52 to the inner peripheral surface 56. The holes 59 can have any suitable size and/or shape. For instance, the holes 59 can be circular, oval, rectangular, triangular, or polygonal. Each of the holes 59 can have a substantially constant cross-sectional area along its length. The holes 59 can be substantially identical to each other, or at least one of the holes 59 can be different from the other holes 59 in one or more respects. The holes 59 can be arranged on the liner 54 in various ways. In one embodiment, the holes 59 can be arranged in groups. Within each group, the holes 59 can be arranged in rows and columns.

The plurality of resonators 50 can be distributed circumferentially about the outer peripheral surface 52 of the liner 54. In one embodiment, the resonators 50 can be substantially equally spaced about the liner 54. The resonators 50 can be substantially circumferentially aligned so that a row of resonators 50 is formed. Each of the plurality of resonators 50 can be identical to each other, or at least one of the resonators 50 can be different from the other resonators 50 in at least one respect, including, for example, height, width, length, volume, shape and frequency damping characteristic, just to name a few possibilities.

The resonators 50 can have any suitable form. Generally, the resonators 50 can include a radially outer wall 72 and one or more side walls 74. The term "radially outer" is intended to mean in the radial direction relative to the longitudinal axis 68 of the liner 54. The radially outer wall 72 can defined the outermost portion of the resonator 50. The radially outer wall 72 can be substantially flat, or it can be curved. In some instances, no holes are provided in the radially outer wall 72, as is shown in FIG. 5.

However, in some instances, a plurality of holes 73 can extend through the radially outer wall 72, as is shown in FIG. 2. In such case, the holes 73 can have any cross-sectional shape and size. For instance, the holes 73 can be circular, oval, rectangular, triangular, or polygonal. Each of the holes 73 can have a substantially constant cross-sectional area along its length. The holes 73 can be substantially identical to each other, or at least one of the holes 73 can be different from the other holes 73 in one or more respects. The holes 73 can be arranged on the radially outer wall 72 in various ways. In one embodiment, the holes 73 can be arranged in rows and columns.

The at least one side wall 74 can extend from each side of the radially outer wall 72 at or near the periphery of the radially outer wall 72. The one or more side walls 74 can generally extend about entire periphery of the radially outer wall 72. As a result, the sides of the resonator 50 can be generally closed. That is, the side walls 74 of the resonator 50 may have no holes extending therethrough. In one embodiment, the one or more side walls 74 can be substantially perpendicular to the radially outer wall 72. Alternatively, the one or more side walls 74 may be non-perpendicular to the radially outer wall 72, as is shown in FIG. 2.

The one or more side walls 74 of the resonator 50 can be formed in any suitable manner. In one embodiment, the radially outer wall 72 and the at least one side wall 74 can be formed as a unitary structure, such as by casting or stamping. Alternatively, the at least one side wall 74 can be made of one or more separate pieces, which can be attached to the radially outer wall 72 and/or to each other in any suitable manner, such as by welding, welding, brazing or mechanical engagement. In either case, a resonator box 76 can be formed. The side walls 74 can be attached to the outer peripheral surface 52 of the liner 54 such that the one or more side walls 74 and radially outer wall 72 protrude outwardly from the outer peripheral surface 52 of the liner 54, as shown in FIG. 2.

In another embodiment, the side walls 74 can be formed at least in part by a portion of the liner 54. For instance, a recess (not shown) can be formed in the outer peripheral surface 52 of the liner 54. The side walls of the recess can form the side walls 74 of the resonator 50. In such resonator configuration, the radially outer wall 72 can be attached directly to the outer peripheral surface 52 of the liner 54. In such case, the radially outer wall 72 would be the only portion of the resonator 50 that extends outwardly from the outer peripheral surface 52 of the liner 54.

Regardless of the manner in which the one or more side walls 74 are formed, the one or more side walls 74 can surround at least some of the plurality of holes 59 in the liner 54. The resonator 50 can include an inner cavity 78, which can be defined between the radially outer wall 72, the one or more side walls 74 and the liner 54.

Figure 3:
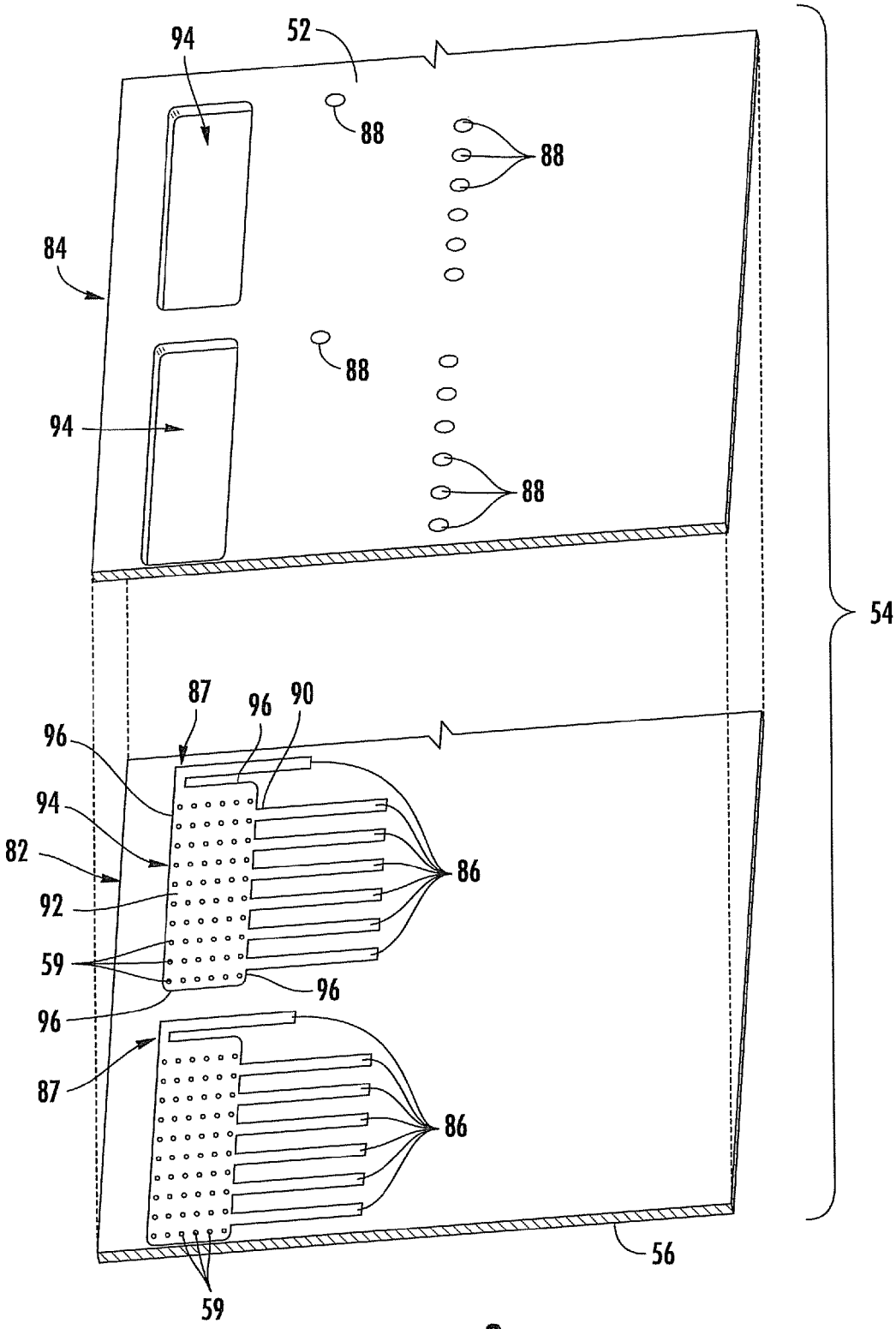
FIG. 3 is an exploded view of a portion of one combustor liner configured according to aspects of the invention, wherein the combustor liner is formed by an inner panel and an outer panel that form a combustor liner body.

The resonators 50 can have any suitable shape. For instance, the radially outer wall 72 can be generally rectangular, as is shown in FIG. 3 and as is disclosed in U.S. Pat. No. 6,530,221, which is incorporated herein by reference. Alternatively, the radially outer wall 72 can be generally parallelogram or generally trapezoidal in conformation, examples of which are disclosed in U.S. Patent Application Publication No. 2009/0094985, the disclosure of which is incorporated herein by reference. In one embodiment, the radially outer wall 72 can be generally triangular in shape. Naturally, the one or more side walls 74 and/or the holes 59 in the liner 54 can be configured accordingly to cooperate with such conformations of the radially outer wall 72.

The resonators 50 can be oriented in any suitable manner. In one embodiment, the resonators 50 can be oriented in the same direction. FIG. 4 shows an example of such an arrangement. However, in other embodiments, one or more of the resonators 50 can be oriented in a different direction from one or more of the other resonators 50. For example, one or more of the resonators in FIG. 4 could be rotated at about 90 degrees relative to the orientation shown.

According to aspects of the invention, air or other suitable fluid can be supplied to the inner cavity 78 by a plurality of cooling passages 80 extending within the body 58 of the liner 54. The cooling passages 80 can extend generally in the longitudinal direction, that is, in the direction of the longitudinal axis 68 of the liner 54. Each of the cooling passages 80 can be in fluid communication with the inner cavity 78 of a respective one of the resonators 50. There can be any suitable quantity of cooling passages 80.

The cooling passages 80 can be substantially identical to each other, or at least one of the cooling passages 80 can be different from the rest of the cooling passages 80 in one or more respects. The cooling passages 80 can be distributed circumferentially in any suitable manner about the combustor liner 54. In one embodiment, the plurality of cooling passages 80 can be substantially equally spaced in the circumferential direction. The cooling passages 80 can be substantially parallel to each other. "Substantially parallel" means true parallel and slight variations therefrom. Alternatively, at least one of the cooling passages 80 may be non-parallel to the other channels.

There can be any suitable quantity of cooling passages 80 associated with each resonator 50. In one embodiment, the same quantity of cooling passages 80 can be associated with each resonator 50. In another embodiment, one or more of the resonators 50 can have a different quantity of cooling passages 80 associated therewith that is different from the one or more of the other resonators 50.

The cooling passages 80 can have any suitable cross-sectional size and/or shape. For instance, the cooling passages 80 can be substantially circular, semi-circular, oval, trapezoidal, triangular, rectangular or polygonal, just to name a few possibilities. The cross-sectional area of the cooling passages 80 can be substantially constant, or the cross-sectional area can vary along at least a portion of the length of the cooling passages 80. The cooling passages 80 can be substantially straight, or one or more of the channels 80 can include one or more non-straight features, such as curves, bends or angles. The cooling passages 80 can all be substantially the same length, or at least one of the passages can have a different length than the other cooling passages 80. The cooling passages 80 can include one or more features (not shown) to generate turbulence in the flow therethrough to increase the heat transfer coefficient in the cooling passages 80. Any suitable turbulence generating features can be provided along the cooling passages 80, including, for example, ribs, dimples or protrusions.

Figure 11:
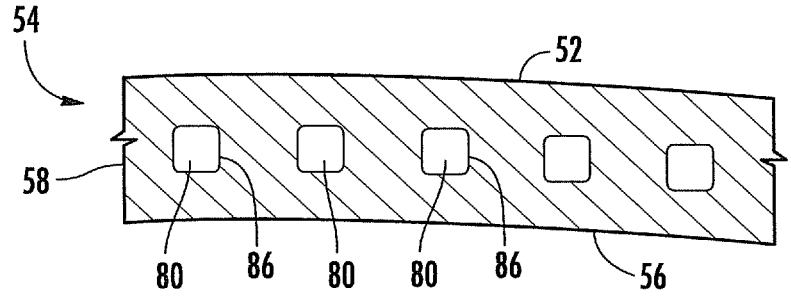
FIG. 11 is a side elevation cross-sectional view of a portion of a combustor liner according to aspects of the invention, showing cooling passages formed in a monolithic combustor liner body.

The cooling passages 80 can be formed in the liner 54 in any suitable manner. In one embodiment, the liner 54 can be a monolithic structure, that is, one that is made of a single material and only a single layer, at least in the region of the cooling passages 80. An example of such a construction is shown in FIG. 11. In such case, the passages 80 can be cast or machined into the body 58 of the liner 54.

In another embodiment, the liner 54 can be formed from two or more panels including an inner panel 82 and an outer panel 84, as is shown in FIG. 3. The terms "inner" and "outer" are intended to mean relative to the longitudinal axis 64 of the liner 54. The inner and outer panels 82, 84 can be substantially flat sheets. The inner and outer panels 82, 84 can be made of any suitable material, including, for example, Inconel 617. The inner and outer panels 82, 84 can be made of the same material, or the inner and outer panels 82, 84 can be made of different materials.

The cooling passages 80 can be formed in the inner and outer panels 82, 84 in any suitable manner. For instance, a plurality of channels 86 can be formed in the inner panel 82 and/or the outer panel 84. The channels 86 can at least partly define the cooling passages 80. The channels 86 can be formed in the inner panel 82 and/or the outer panel 84 in any suitable manner, including by milling, laser cutting and/or electrochemical machining, just to name a few possibilities.

Figure 6:
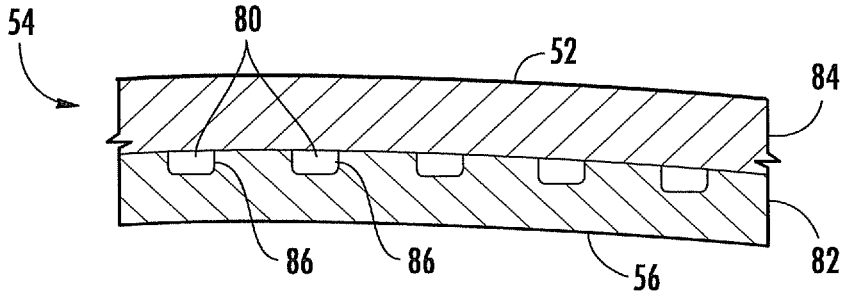
FIG. 6 is a side elevation cross-sectional view of a portion of a combustor liner according to aspects of the invention, showing cooling passages formed in part by channels in an inner panel.
Figure 7:
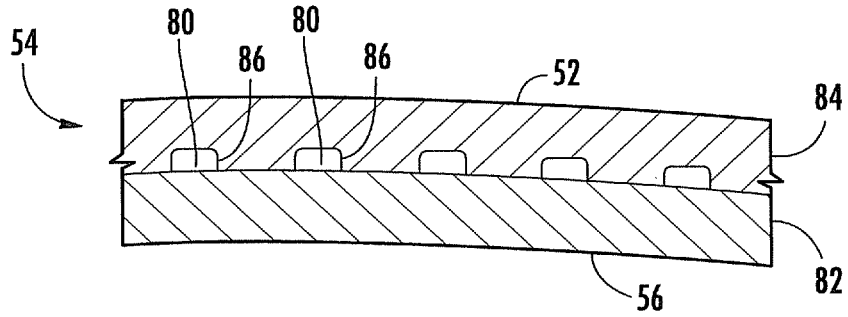
FIG. 7 is a side elevation cross-sectional view of a portion of a combustor liner according to aspects of the invention, showing cooling passages formed in part by channels in an outer panel.
Figure 8:
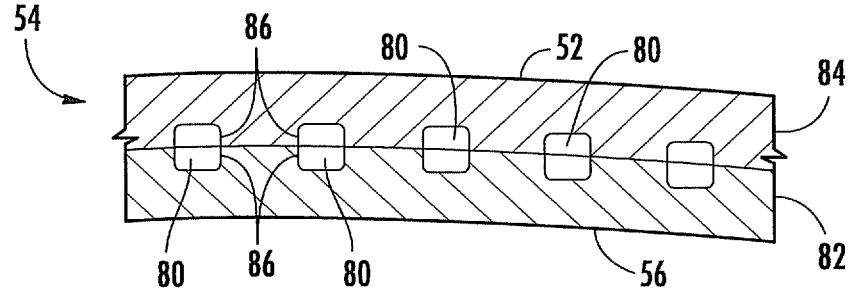
FIG. 8 is a side elevation cross-sectional view of a portion of a combustor liner according to aspects of the invention, showing cooling passages cooperatively formed by channels in an inner panel and channels in the outer panel.
Figure 9:
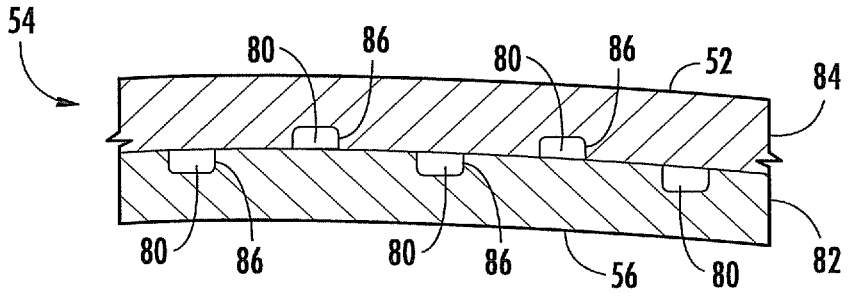
FIG. 9 is a side elevation cross-sectional view of a portion of a combustor liner according to aspects of the invention, showing a first group of cooling passages formed in part by channels in an inner panel and a second group of cooling passages formed in part by channels in an outer panel.

The cooling passages 80 can be collectively defined by the inner and outer panels 82, 84. For instance, one or more of the cooling passages 80 can be defined in part by channels 86 formed in only the inner panel 82, as is shown in FIGS. 3 and 6. Alternatively, one or more of the cooling passages 80 can be defined by the inner channels 85 formed in only the outer panel 84, as is shown in FIG. 7. Still alternatively, one or more of the cooling passages 80 can be defined at least in part by a channel 86 formed in the outer panel 84 and a channel 86 formed in the inner panel 82. FIG. 8 shows an embodiment in which the one or more of the cooling passages 80 is cooperatively formed by a channel 86 in the outer panel 84 and a channel in the inner panel 82. FIG. 9 shows an embodiment in which a first group of cooling passages 80 is formed by channels 86 in the outer panel 84 and in which a second group of cooling passages 80 is formed by channels in the inner panel 82. The channels 86 in the outer panel 84 can alternate with channels provided in the inner panel 82. Of course, combinations of these configurations are possible.

Figure 10:
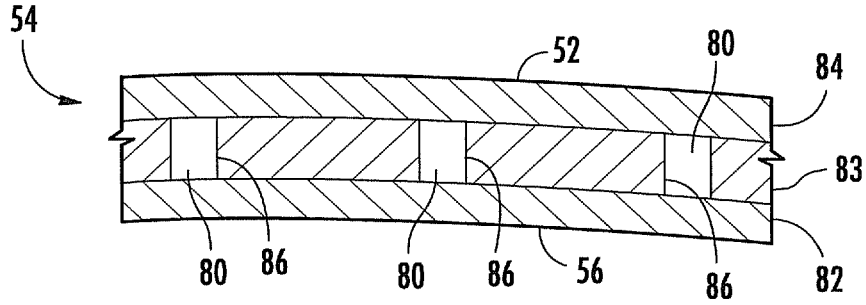
FIG. 10 is a side elevation cross-sectional view of a portion of a combustor liner according to aspects of the invention, showing cooling passages cooperatively formed in part by channels in an intermediate panel.

Again, it will be understood that, in embodiments of the invention are not limited to constructions in which the liner 54 is made of only two panels. Indeed, as noted above, the liner 54 can be a monolithic structure, as is shown in FIG. 11. Alternatively, the liner 54 can be made of three or more panels. FIG. 10 shows an embodiment in which the liner 54 comprises an inner panel 82, an outer panel 84 and an intermediate panel 83 disposed therebetweeen. In such instances, the cooling channels 86 can be provided in the inner panel 82, the intermediate panel 83 and/or the outer panel 84 in any suitable manner. For instance, as is shown in FIG. 10, channels 886 can be formed in only the intermediate panel 83. In such case, the channels 86 may extend through the entire thickness of the intermediate panel 83.

A plurality of inlets 88 can be provided in the outer panel 84. The inlets 88 can be in the form of an apertures that extends through at least a portion of the thickness of the outer panel 84. The inlets 88 can be formed in the outer panel 84 in any suitable manner, such as by milling, laser cutting and/or electrochemical machining.

The inlets 88 can have any suitable cross-sectional size or shape. For instance, the inlets 88 can be circular, oval, slotted, rectangular, triangular, or polygonal. Each of the inlets 88 can have a substantially constant cross-sectional area along its length, or the cross-sectional area of at least one of the inlets 88 can be vary along at least a portion of its length. The inlets 88 can be substantially identical to each other, or at least one of the inlets 88 can be different from the other inlets 88 in one or more respects, including in any of those described above. Each of the inlets 88 can be in fluid communication with a respective one of the cooling passages 80.

The inner and outer panels 82, 84 can be brought together so that the inlets 88 in the outer panel 84 are in fluid communication with a respective one of the cooling passages 80. The inner and outer panels 82, 84 can be joined together in any suitable manner, such as by bonding. The joined inner and outer panels 82, 84 can then be formed into a cylindrical shape, such as by rolling. The circumferential ends of the bonded inner and outer panels 82, 84 can be joined, such as by welding or bonding, to form the liner 54.

In some instances, the resonator box 76 can be disposed on the outer peripheral surface 52 of the liner 54. Alternatively, the liner 54 can include a recess 92 into which a portion of the resonator box 76 can be received, as is shown in FIGS. 3 and 5. The recess 92 can be formed by a cutout 94 formed in the outer panel 84. The cutout 94 can be sized and shaped to receive at least a portion of the side walls 74 of the resonator box 76 therein. The recess 92 can have a similar shape to the outer perimeter of the resonator box 76. The side walls 74 of the resonator box 76 can be attached to the outer panel 84 in any suitable manner, such as by welding. In one embodiment, the recess 92 can be sized and shaped so that the side walls 74 of the resonator box 76 are substantially flush with corresponding walls 96 (FIG. 3) of the recess 92.

A plurality of holes 59 can be formed in the inner panel 82. The holes 59 can be enclosed within the walls 96 of the recess 92. The holes 59 can allow fluid communication between the inner cavity 78 and the interior of the liner 54. The holes 59 can have any suitable cross-sectional shape and size. For instance, the holes 59 can be circular, oval, rectangular, triangular, or polygonal, just to name a few possibilities. Each of the holes 59 can have a substantially constant cross-sectional area along its length. The holes 59 can be substantially identical to each other, or at least one of the holes 59 can be different from the other holes 59 in one or more respects. The holes 59 can be arranged in various ways. In one embodiment, the holes 59 can be arranged in rows and columns.

In some instances, there can be a single recess 92 associated with each resonator box 76, as is shown in FIG. 2. Alternatively, there can be a plurality of recesses 92 associated with one or more of the resonator boxes 76. For example, as is shown in FIG. 4, a resonator box 76 can enclose three recesses 92 formed in the inner panel 82. The perimeter of the resonator box 76 as well as the inlets 88 in the outer panel 84 are shown in dashed lines for reference.

As noted above, the cooling passages 80 can be in fluid communication with the inner cavity 78 of the resonators 50. The cooling passages 80 can have an outlet 90. In one embodiment, the outlets 90 of the cooling passages 80 can be formed in one of the walls 96 defining the recess 92. Thus, a cooling fluid, such as air, traveling along the cooling passages 80 is exhausted directly into the recess 92, as is shown in FIG. 2.

In some instances, the cooling passages 80 may not exhaust directly into the recess 92. An example of such an arrangement is shown in FIGS. 4 and 5. Referring to FIG. 4, it can be seen that the cooling channels 86 (and, thus, cooling passages 80) can stop short of the recess 92. However, the outlets 90 of the channels 86 are enclosed within the side walls 76 of the resonator 50 (shown in dashed lines in FIG. 4) and thereby in fluid communication with the inner cavity 78. Thus, when the cooling fluid reaches the outlets 90 of the channels 86, it can encounter a barrier 87 formed by the inner panel 82, as is shown in FIG. 5. The barrier 87 can define a portion of one of the walls 96 defining the recess 92. In such case, the coolant flow can be directed upward and can promote more homogenous distribution of air in the inner cavity 78.

It should be noted that the cooling passages 80 can be arranged in any suitable manner within the liner 54. The inlets 88 can be positioned upstream of the resonator 50 relative to the direction of fluid flow 102 within the liner 54. Alternatively, the inlets 88 can be positioned downstream of the resonator 50 relative to the direction of fluid flow within the liner 54. Still alternatively, a first portion of the inlets 88 can be positioned upstream of the resonator 50, and a second portion of the inlets 88 can be positioned downstream of the resonator 50. An example of such an arrangement is shown in FIG. 4.

As noted above, the resonators 50 can be arranged in any suitable manner. In some instances, the resonators 50 can be arranged in a plurality of rows. FIG. 4 shows an example of a liner 54 including a first row of resonators 50' and a second row of resonators 50". In such case, the resonators 50 can be arranged accordingly and the cooling passages 80 can be arranged accordingly. For instance, the cooling passages 80 associated with the first row of resonators 50' can be arranged so that their inlets 88 are located upstream of the resonator 50, and the cooling passages 80 associated with the second row of resonators 50" can be arranged so that their inlets 88 are located downstream of the resonators 50. Here, the terms "upstream" and "downstream" are used relative to the direction of fluid flow 100 on the outside of the liner 54, as this flow 100 can be the source of cooling air into the cooling passages 80.

At least some of the cooling passages 80 associated with the first row of resonators 50' can pass between neighboring resonators 50 and/or neighboring recesses 92 in the second row of resonators 50". Alternatively or in addition, at least some of the cooling passages 80 associated with the second row of resonators 50" can pass between neighboring resonators 50 and/or neighboring recesses 92 in the first row of resonators 50', as is shown in FIG. 4. It should be noted that the resonators 50 in the first row 50' can be offset from the resonators 50 in the second row 50". FIG. 4 shows an example of such an arrangement. In such case, the space between side walls of neighboring resonators 50 in the first row 50' can be generally aligned with a middle region of a respective one of the resonators 50 in the second row 50".

In operation, a coolant, such as air compressor discharge air 100, can enter the cooling passages 80. The coolant can flow along the cooling passages 80, providing cooling to the liner 54. Such cooling can be particularly beneficial when the coolant enters the cooling passages 80 upstream of the resonator 50 relative to the direction of flow of the compressor discharge air 100, as it creates a cross-flow with the hot gas flow 102 in the liner 54. The air 100 can enter the inner cavity 78 and can purge the cavity.

It will be readily appreciated that a system according to aspects of the invention can have numerous benefits. For example, the system can decrease the amount of cooling air consumption in the engine because the air serves a dual purpose—initially it is used to cool the liner 54 and then it is used to purge the inner cavity 78 of the resonator 50. As a result, more air can be used for other beneficial purposes in the engine. Further, an improved cooling efficiency can be realized since cold air is provided to the hottest section of the combustor and, in some instances, the counter-flow heat exchanging arrangement can further increase cooling effectiveness. The system can also efficiently reduce the temperature of welds around the resonators. Further, the system according to aspects of the invention affords the ability to fine tune the cooling to provide cooling air to those areas where it is needed (i.e., more air in the zones of the combustor where a higher hear load is present).

Examples have been described above regarding a resonator system with enhanced combustor liner cooling. The system has been described herein in connection with a combustor liner, but it will be understood that the system is not limited to being used in connection with liners. Thus, it will of course be understood that the invention is not limited to the specific details described herein, which are given by way of example only, and that various modifications and alterations are possible within the scope of the invention as defined in the following claims.

What is claimed is:

1. A resonator system for a turbine engine comprising:

a hollow combustor component having an outer peripheral surface and an inner peripheral surface, a first plurality of holes extending substantially radially through the combustor component from the inner peripheral surface to the outer peripheral surface, the first plurality of holes being distributed circumferentially about the combustor component;

a first plurality of resonators formed with the combustor component, each resonator having a radially outer wall and at least one side wall, each resonator having an inner cavity defined between the radially outer wall, the at least one side wall and the combustor component, the at least one side wall of each resonator surrounding a subset of the first plurality of holes, the first plurality of resonators being substantially circumferentially aligned about the combustor component to form a first row of resonators; and a first plurality of cooling passages extending generally longitudinally within the combustor component, each of the first plurality of cooling passages having an inlet in fluid communication with the exterior of the combustor component and an outlet in fluid communication with the inner cavity of a respective one of the resonators.

2. The system of claim 1, wherein the combustor component is a combustor liner.

3. The system of claim 1, wherein the radially outer wall of at least one of the resonators is free of holes.

4. The system of claim 1, wherein the combustor component is formed by an inner panel and an outer panel, wherein the plurality of first cooling passages is defined by the inner and outer panels.

5. The system of claim 4, wherein the plurality of first cooling passages is defined by a plurality of channels formed in at least one of the inner panel and the outer panel.

6. The system of claim 4, further including an intermediate panel disposed between the inner and outer panels, wherein at least one of the plurality of first cooling passages is defined in part by a plurality of channels formed in the intermediate panel.

7. The system of claim 4, wherein the inner cavity is defined in part by a recess formed in the inner panel, wherein the recess is at least partly defined by a wall, and wherein the cooling passages have an outlet formed in the wall.

8. The system of claim 4, wherein the inner cavity is defined in part by a recess formed in the inner panel, wherein the recess includes a wall, wherein the cooling passages extend toward but stop short of the recess, wherein each of the cooling passages has an outlet, wherein the outlets are separated from the recess, and wherein the outlets of the cooling passages and the recess are enclosed within the at least one side wall of a respective resonator.

9. The system of claim 4 wherein the inner cavity is defined in part by a plurality of recesses formed in the inner panel, and wherein the at least one side wall of each resonator surrounds a subset of the plurality of recesses.

10. The system of claim 1, wherein the inlets of the first plurality of cooling passages are located upstream of the resonator relative to the direction of a fluid flow within the combustor component.

11. The system of claim 1, wherein the inlets of the first plurality of cooling passages are located downstream of the resonator relative to the direction of a fluid flow within the combustor component.

12. The system of claim 1, wherein at least a portion of at least one of the first plurality of cooling passages is non-straight.

13. The resonator system of claim 1, wherein, for at least one of the first plurality of resonators, the radially outer wall and the at least one side wall are formed as a resonator box, the at least one side wall of the resonator box being attached to the combustor component so that the resonator box protrudes outwardly from the outer peripheral surface of the combustor component.

14. The resonator system of claim 1, further including:

a second plurality of holes extending substantially radially through the combustor component, the first plurality of holes being distributed circumferentially about the combustor component;

a second plurality of resonators formed with the combustor component, each resonator having a radially outer wall and at least one side wall, each resonator having an inner cavity defined between the radially outer wall, the at least one side wall and the outer peripheral surface of the combustor component, the at least one side wall of each resonator surrounding a subset of the second plurality of holes, the second plurality of resonators being substantially circumferentially aligned about the combustor component to form a second row of resonators; and a second plurality of cooling passages extending generally longitudinally within the combustor component, each of the second plurality of cooling passages having an inlet in fluid communication with the exterior of the combustor component and an outlet in fluid communication with the inner cavity of a respective one of the second plurality of resonators.

15. The resonator system of claim 14, wherein the inlets of the first plurality of cooling passages are located upstream of the first plurality of resonators relative to the direction of a fluid flow within the combustor component, and wherein the inlets of the second plurality of cooling passages are located downstream of the first plurality of resonators relative to the direction of a fluid flow within the combustor component.

16. The resonator system of claim 14 wherein the at least one of the first plurality of cooling passages passes between two neighboring resonators of the second plurality of resonators.

17. A resonator system for a turbine engine comprising:

a hollow combustor liner having an outer peripheral surface and an inner peripheral surface, a plurality of holes extending substantially radially through the combustor liner, the plurality of holes being distributed circumferentially about the combustor liner, the combustor liner being formed by a plurality of panels;

a plurality of resonators formed with the combustor liner, each resonator having a radially outer wall and at least one side wall, each resonator having an inner cavity defined between the radially outer wall, the at least one side wall and the combustor liner, the at least one side wall of each resonator surrounding a subset of the plurality of holes, the plurality of resonators being substantially circumferentially aligned about the combustor liner to form a first row of resonators; and a plurality of cooling passages extending generally longitudinally within the combustor liner, each cooling passage having an inlet in fluid communication with the exterior of the combustor liner and an outlet in fluid communication with the inner cavity of a respective one of the resonators, the plurality of cooling passages being defined in part by channels formed in at least one of the plurality of panels.

18. The system of claim 17, wherein the radially outer wall of at least one of the plurality of resonators is free of holes.

19. The system of claim 17, wherein the inlets of the plurality of cooling passages are located upstream of the resonator relative to the direction of a fluid flow within the combustor liner.

20. The system of claim 17, wherein the inlets of the plurality of cooling passages are located downstream of the resonator relative to the direction of a fluid flow within the combustor liner.

* * * * *